United States Patent [19]

Arnold et al.

[11] Patent Number: 4,965,418

[45] Date of Patent: Oct. 23, 1990

[54] MOLDED CASE CIRCUIT BREAKER LINE STRAP CONFIGURATION

[75] Inventors: David Arnold, Chester; Karen B. Kowalczyk, New Britain, both of Conn.

[73] Assignee: General Electric Company, New York, N.Y.

[21] Appl. No.: 292,717

[22] Filed: Jan. 3, 1989

[51] Int. Cl.[5] ..... H01H 33/02

[52] U.S. Cl. ..... 200/144 R

[58] Field of Search ..... 200/144 R

[56] References Cited

U.S. PATENT DOCUMENTS 4,679,016 7/1987 Ciarcia et al. ..... 335/132

4,748,301 5/1988 Goldman et al. ..... 200/144 R

*Primary Examiner*—Robert S. Macon

*Attorney, Agent, or Firm*—Richard A. Menelly; Walter C. Bernkopf; Fred Jacob

[57] ABSTRACT

A molded case circuit breaker enclosure cooperates with the current-limiting line strap to prevent the egress of ionized gases. The gases are generated by a high temperature arc which occurs when the contacts are separated under short circuit conditions.

9 Claims, 4 Drawing Sheets

MOLDED CASE CIRCUIT BREAKER LINE STRAP CONFIGURATION

BACKGROUND OF THE INVENTION

Current-limiting circuit breakers are currently designed to interrupt a fault condition in the early stages of the let-through current waveform to substantially reduce the intensity of the arc that occurs between the contacts during the rapid separation process. To promote the electrodynamic repulsion that occurs between the fixed line strap that supports the line contact and the movable contact arm that supports the movable contact, the line strap is provided with a "reverse loop" configuration. One example of an efficient current-limiting circuit breaker employing such a reverse loop line strap is found within U.S. Pat. No. 4,679,016 which Patent is incorporated herein for purposes of reference.

In order to rapidly de-ionize and thermally quench the arc, an arc chute configuration is employed having good mechanical strength and further having the ability to generate electronegative gases which both de-ionize as well as thermally cool the arc. One example of an arc chute composition having specific gas evolving properties is described within U.S. Pat. No. 4,748,301 which Patent is also incorporated herein for reference purposes.

To prevent the egress of such ionized gases from the circuit breaker enclosure, a sealant material is generally applied to the outside of the circuit breaker enclosure where the line straps exit to join the line strap connecting lugs. With the advent of robotic assembly of the circuit breaker components, it is essential to eliminate as many production steps as possible in order not to interfere with the efficiency of the components assembly process.

One purpose of the instant invention is to provide means for automatically sealing the circuit breaker enclosure from the arc gases generated during circuit interruption without requiring any sealant material on the exterior of the circuit breaker enclosure.

SUMMARY OF THE INVENTION

The invention comprises a reverse loop line conductor that is configured to cooperate with complementary extensions formed on the interior of a circuit breaker molded plastic case. The bottom interior of the case is configured to accept the reverse loop line strap in a press-fit configuration.

DESCRIPTION OF THE PREFERRED EMBODIMENT

Figure 1:
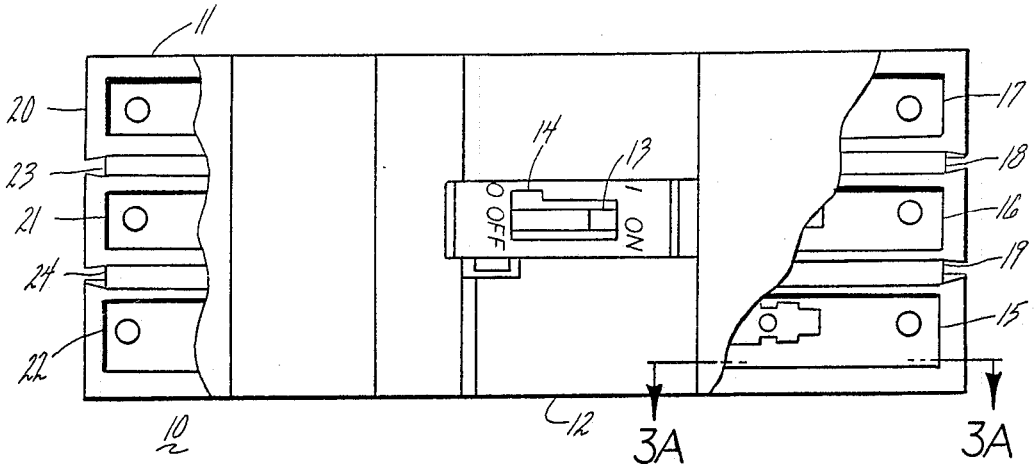
FIG. 1 is a plan view of a molded case circuit breaker with the cover partially removed to show the line straps according to the invention.

A current-limiting circuit breaker 10 is depicted in FIG. 1 and includes a molded plastic case 11 to which a molded plastic cover 12 is secured. The cover includes an ON-OFF operating handle 13 that exits through the cover aperture 14. Electrical connection with the electrical distribution power buses (not shown) is made by means of the line straps 15–17 which are electrically isolated from each other by means of integrally-formed baffles 18, 19. Electrical connection with an associated load is made by means of the load straps 20–22 which are similarly isolated from each other by means of integrally-formed baffles 23, 24.

Figure 4:
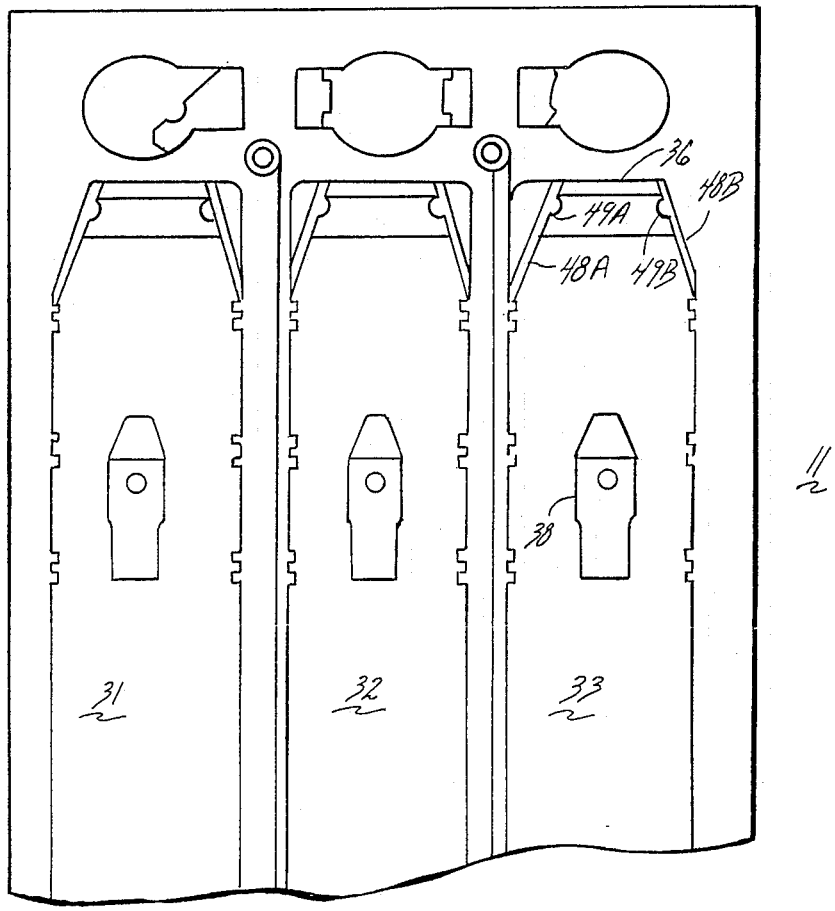
FIG. 4 is a cut-away plan view of the circuit breaker case depicted in the preceding drawings.
Figure 2:
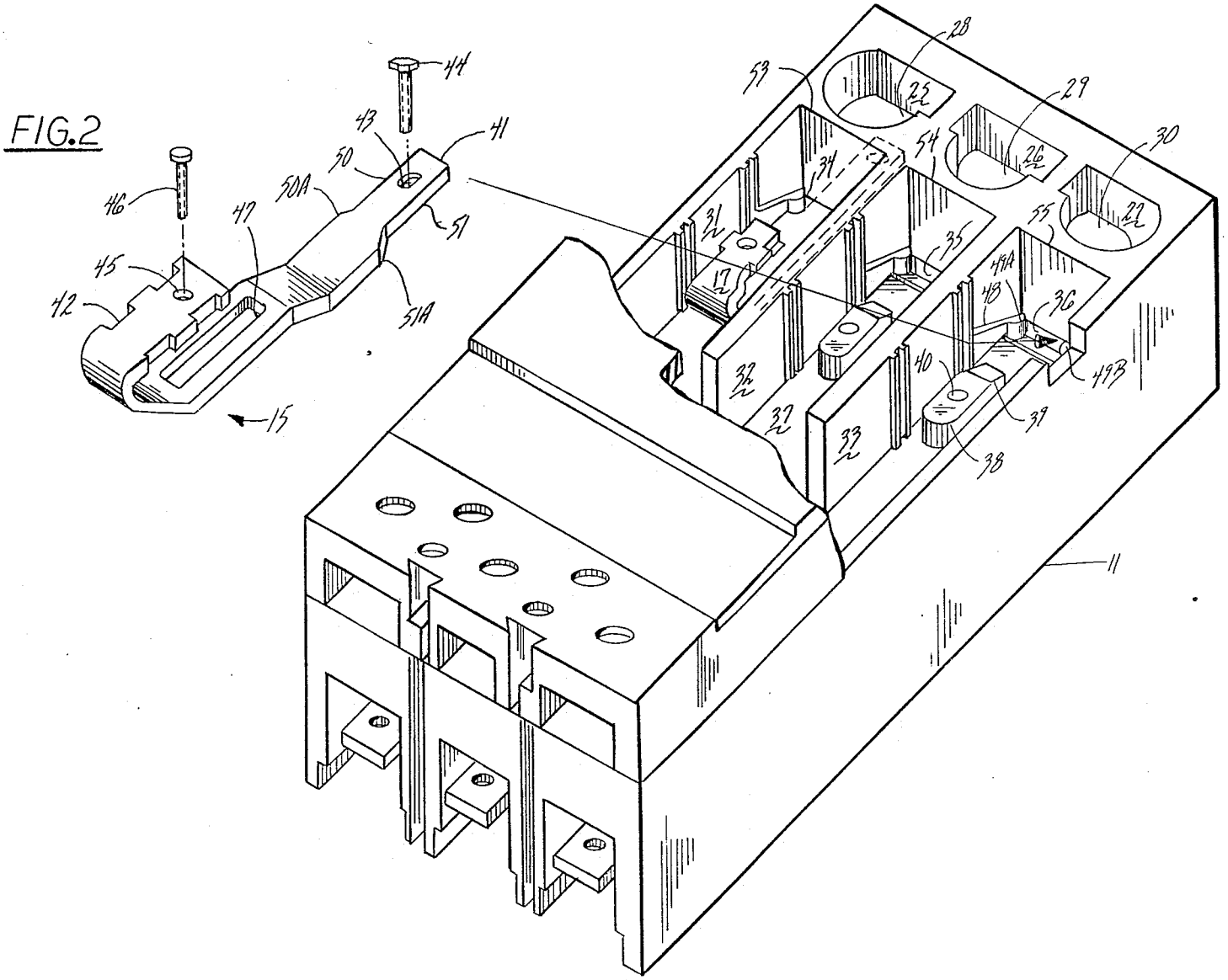
FIG. 2 is a top perspective view of the circuit breaker of FIG. 1 with the cover partially removed and the line straps in isometric projection.

The line straps, such as depicted at 15 in FIG. 2 are each assembled within corresponding arc chambers 31–33 such that the forward part 41 extends through slots 34–36 to within the line lug compartments 25–27. Walls 53–55 are integrally-formed within the circuit breaker case and separate the arc chambers from the line lug compartments. The line lug compartments are externally accessible through the openings 28–30 formed in the end of the case. In assembling the line strap 15 within the arc chamber 33, for example, the forward part 41 is inserted within slot 36 and extended through the slot until the ridges 50A, 51A formed on the respective edges 50, 51 strike against the protuberances 49A, 49B in the arc chamber 33 that are formed at the juncture between wedge-shaped extensions 48 and the corresponding slot 36. The line strap is then rotated down until the slot 47 formed in the line strap encompasses the pedestal 38 integrally-formed in the bottom 37 of the case and which includes a forward sloped surface 39 to guide and accommodate the line strap. An opening 40 receives a retainer screw 46 for fastening the line strap to the case by means of the thru-hole 45 formed in the reverse loop part 42 of the line strap. When the line strap is fastened to the case, the busbar connector 44 is threadingly attached by means of the threaded opening 43 formed in the forward part 41 which extends within the line lug compartment 27. The case 11 is depicted in FIG. 4 to show the protuberances 49A, 49B on opposite sides of the slot 36 and formed on opposing wedge-shaped extensions 48A, 48B ahead of the pedestal 38.

Figure 3A:
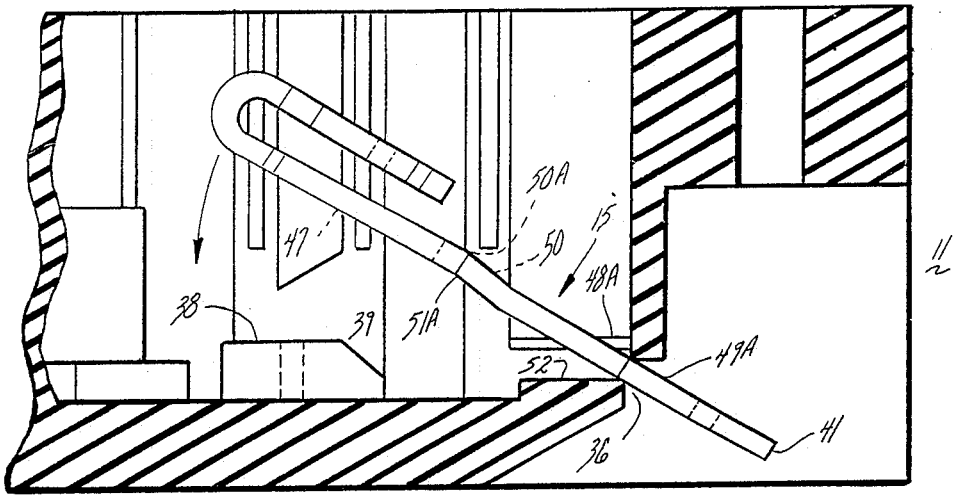
FIGS. 3A and 3B are side views in partial section depicting the assembly of the line straps shown in FIG. 1 and 2.
Figure 3B:
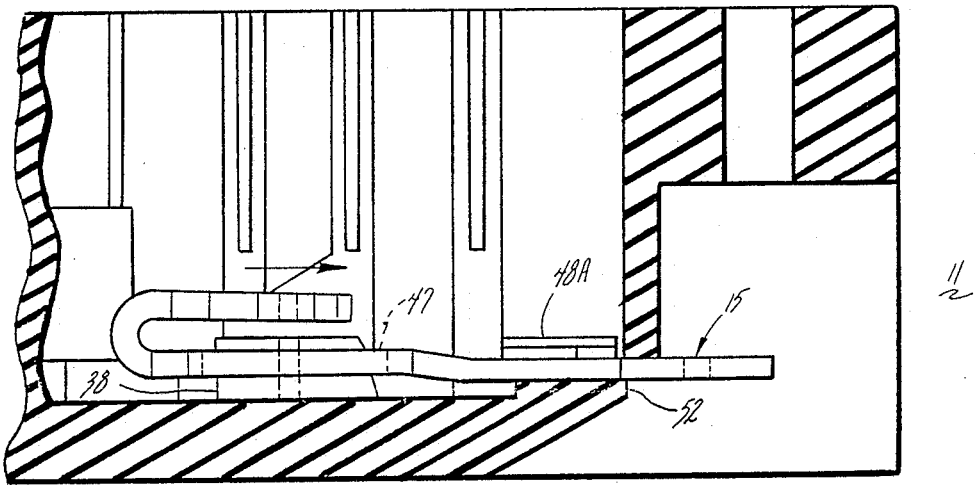

The assembly of the line strap 15 is best seen by now referring to FIGS. 3A, 3B wherein the forward part 41 is shown extending through slot 36 with the ridge 50A of the tapered edge 50 stopped against the protuberance 49A formed on the wedge-shaped extension 48A on one side of the slot 36. The ridge 51A on the opposing tapered edge 51 also stops against a similar protuberance 49B shown earlier in FIG. 4. A projection 52 is formed on the bottom of the case 11 to provide for a press-fit connection between the line strap 15 and the top and bottom edges of the slot 36 when the line strap is next rotated in the downward direction to capture the pedestal 38 within the slot 47. As described earlier, the forward sloped surface 39 guides the line strap slot over the pedestal until the line strap becomes completely supported by the bottom of the case as best seen in FIG. 3B.

Figure 5:
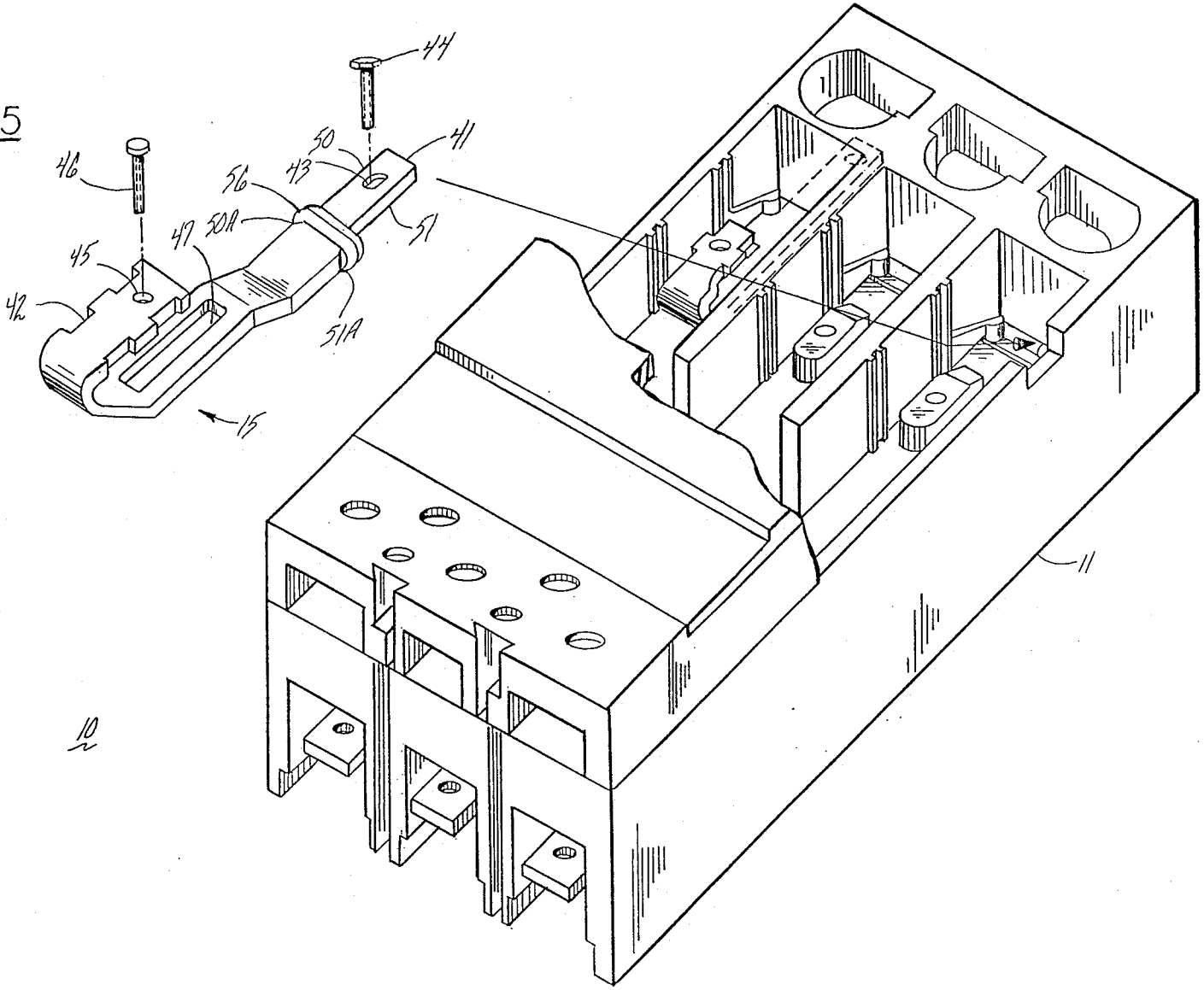
FIG. 5 is a top perspective view of the circuit breaker of FIG. 1 depicting an alternative embodiment of the line strap of the invention.

In some circuit breakers having higher ampere ratings, an elastomeric O-ring or washer 56 is first arranged over the forward part 41 of the line strap 15, shown in FIG. 5, until the washer becomes stopped by the ridges 50A, 51A formed at the ends of the tapered edges 50, 51. When the line strap is later inserted within the corresponding slot 36, the washer 56 completely seals the interstices that may occur when the line strap forward part 41 is completely inserted through slot 36.

Having thus described our invention, what we claim as new and desire to secure by Letters Patent is:

1. A circuit breaker enclosure comprising:

a molded plastic cover;

a molded plastic case including a plurality of line lug compartments at one end and a corresponding plurality of load lug compartments at an opposite end;

a plurality of arc chambers abutting said line lug compartments and separated therefrom by an upstanding compartment wall integrally-formed within said case;

a plurality of line straps within said arc chambers and extending within said line lug compartments through a corresponding plurality of openings through a bottom of said compartment wall, each of said line straps including means formed on one end cooperating with means formed on opposing edges of said openings to thereby prevent the egress of arc gases from said case during circuit interruption.

2. The circuit breaker enclosure of claim 1 including a plurality of pedestals integrally-formed on a bottom surface of said case, said pedestals receiving corresponding slots formed through said line straps.

3. The circuit breaker enclosure of claim 1 wherein each of said line straps comprise a U-shaped configuration including a planar top and bottom part, said line strap means comprising ridges formed on parallel edges of said bottom part.

4. The circuit breaker enclosure of claim 1 wherein said means formed on said openings comprise wedges integrally-formed within said case.

5. The circuit breaker enclosure of claim 3 wherein said parallel edges taper towards each other.

6. The circuit breaker enclosure of claim 2 wherein said pedestals include a forward surface inclining towards said openings to facilitate receiving said line strap slot.

7. The circuit breaker enclosure of claim 1 including projections integrally-formed subjacent said openings to cooperate with said line strap bottom part to further prevent egress of said arc gases.

8. The circuit breaker enclosure of claim 1 including a corresponding plurality of load strap compartments at opposite ends of said case and a corresponding plurality of load straps within said load strap compartments.

9. The circuit breaker enclosure of claim 4 including a corresponding plurality of protuberances formed on said wedges, said protuberances providing stops to said line strap edges when said line straps are inserted through said compartment openings.

* * * * *